US005462509A

United States Patent [19]

Lister

[11] Patent Number: 5,462,509

[45] Date of Patent: Oct. 31, 1995

[54] WAIST, HIP, OR SHOULDER EXERCISE DEVICE ROLLED BY THE USER

[76] Inventor: James F. Lister, Forest Lodge, New Barn Lane, Buriton, Hampshire, United Kingdom, GU31 5SL

[21] Appl. No.: 287,246

[22] Filed: Aug. 8, 1994

[30] Foreign Application Priority Data

Aug. 6, 1993 [GB] United Kingdom ..... 9316382

[51] Int. Cl.[6] ..... A63B 21/22

[52] U.S. Cl. ..... 482/132; 482/142; 482/139; 482/907

[58] Field of Search ..... 482/74, 91, 105, 482/139, 907, 132; 601/124, 112, 113, 114, 122, 132; 280/87.01, 87.021

[56] References Cited

U.S. PATENT DOCUMENTS

| | | | |
|---|---|---|---|
| 806,482 | 12/1905 | Moore | 601/132 |
| 3,636,945 | 1/1972 | Sato | 601/132 |
| 3,861,382 | 1/1975 | Simjian | 601/132 |
| 3,957,039 | 5/1976 | Ehren | 601/132 |
| 3,996,929 | 12/1976 | Mabuchi | 601/124 |
| 4,299,207 | 11/1981 | Pfanstiel | 601/114 |
| 4,700,945 | 10/1987 | Rader | 482/132 |
| 5,336,152 | 8/1994 | Winslow et al. | 482/132 |

FOREIGN PATENT DOCUMENTS

| | | |
|---|---|---|
| 296203 | 11/1991 | Germany . |
| 2198961 | 6/1988 | United Kingdom . |

*Primary Examiner*—Lynne A. Reichard
*Attorney, Agent, or Firm*—Bacon & Thomas

[57] ABSTRACT

The invention relates to a waist, hip, or shoulder exercise device designed to tone or develop the torso muscles through gentle exercise. The device comprises an arcuate body (10) of plastics material or metal shaped to suit a human frame, the body (10) incorporating rollers (11) freely mounted to rotate within the body of the device. At each end there are webbing straps (12 and 13) with hook and loop type or similar attachment devices 14 and 15. The exercise device may be used in conjunction with an adjustable frame and a baseboard. The frame may also include a foot rest or a head or shoulder rest. The wheels or rollers may be driven by electric motors by battery or a main power source.

11 Claims, 2 Drawing Sheets

WAIST, HIP, OR SHOULDER EXERCISE DEVICE ROLLED BY THE USER

BACKGROUND OF THE INVENTION

This invention relates to a general waist/hip and shoulder exercise device, designed to tone or develop the torso muscles through gentle exercise, thereby providing maximum mobility to those body parts over long term usage.

Because of the gentle exercising motion resulting from use of the device, there is a build up of muscle tone over an ongoing period which can give relief from muscle spasm or muscular injury and may even prevent muscular injury due to improved muscle fitness.

An improvement in a patient's muscular condition and, particularly, some relief from muscular pain may be obtained by exercising the area of the hips and waist and shoulders by a side-to-side rotary motion abut the head to foot bodyline axis. In other words the hips are swivelled from left to right without swivelling the remainder of the body or with minimum movement of the body horizontally. The exercise is carried out with the feet flat on the floor and the knees bent for comfort and the head resting comfortably at floor level (a pillow is optional). Alternatively, the exerciser may be used in the vertical position leaning against a wall.

SUMMARY OF THE INVENTION

An object of the present invention is to provide an exercise device which will enable the user to achieve this exercise with a degree of comfort and without problems associated with the friction between the body and the floor or wall which occurs if no apparatus is used. Frequent and prolonged use of the exerciser may also improve cardiovascular circulation.

According to the present invention, there is an exercise device adapted to be fastened around the body of the user at hip or waist or shoulder level and incorporating means to reduce or ease friction between the device and the floor or wall when in use, the device being either flexible so as to take the shape of the user's body or being rigid but pre-shaped to suit the user.

The means to relieve friction may take many forms, but the whole device is adapted to enable the user to lie flat on the floor on his or her back and swivel the hips, supported by the device, from left to right with minimal movement of the body horizontally.

The friction reduction may be achieved by use of rollers, wheels, runners, pistons or ball-race mechanisms or any material or other device which facilitates easy movement.

The exercise device may be manually driven, i.e. by the body of the user, or it maybe power-assisted.

If power-assisted, the device may include rollers or wheels which maybe driven by small electric motors incorporated in the device. The electric motors may be operated by rechargeable batteries in the device or they may be adapted to be driven by mains current via a flexible cable connected to the device.

The device preferably has a harness by which it may be attached to the user so that it may be placed in position over a layer of clothing such as a tracksuit. Hook and loop type fastening strips, such as those sold under the trademark VELCRO, could be used to secure the exercise device to clothing, thus adding greater security with the straps.

The device may be self-contained or it may be used in conjunction with or incorporated in an adjustable frame which may provide a cushioned support for the head and/or back and a foot support which may be adjustable. There may also be a base beard provided to accommodate the exerciser.

DETAILED DESCRIPTION OF THE PREFERRED EMBODIMENT

Figure 1:
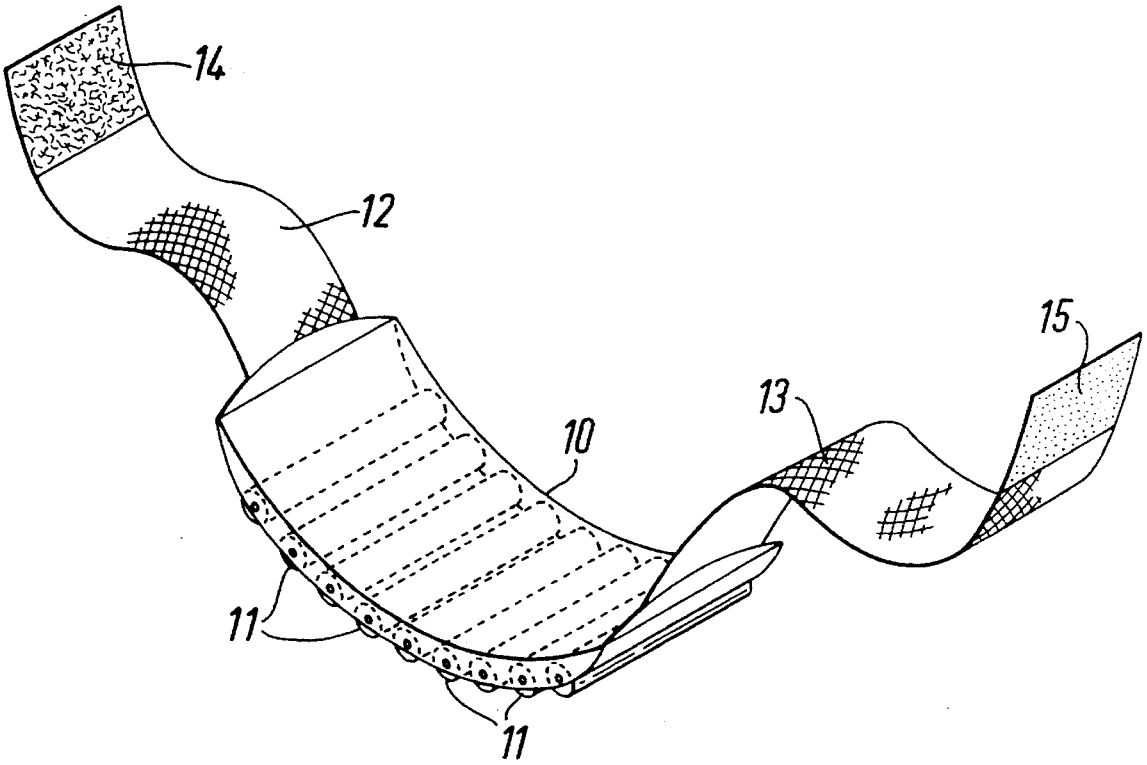
FIG. 1 is an isometric view of an exercise device embodying the present invention, seen from above.

In FIG. 1 the device comprises an arcuate body 10 which may be of flexible plastics material or may be metal shaped as shown to suit a human frame, the body 10 carrying a plurality of rollers 11 which again may be of hard plastic or of steel or other material, the rollers being freely mounted so that they can rotate within the body of the device. At each end of the device there are webbing straps 12 and 13 with hook and loop type or other similar attachment devices 14 and 15 at each end of the webbing straps.

Figure 2:
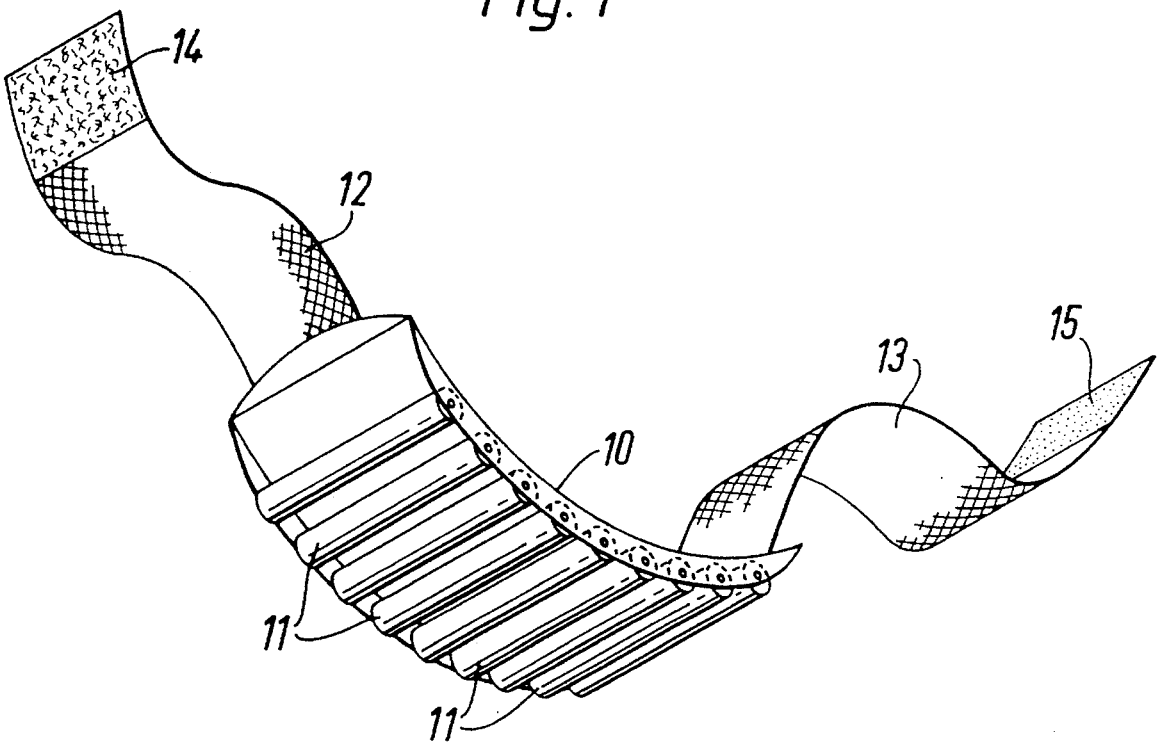
FIG. 2 is a view of the same device seen from underneath.

FIG. 2 shows the device when seen from underneath so that the rollers can be more clearly seen.

In use the exercise device is strapped around the hips or waist or shoulders of the user so that the rollers are on the outside. When the user lies on the floor, the rollers contact the floor and enable the user to swivel the hips using the device to reduce friction and to protect the user from the floor.

Figure 3:
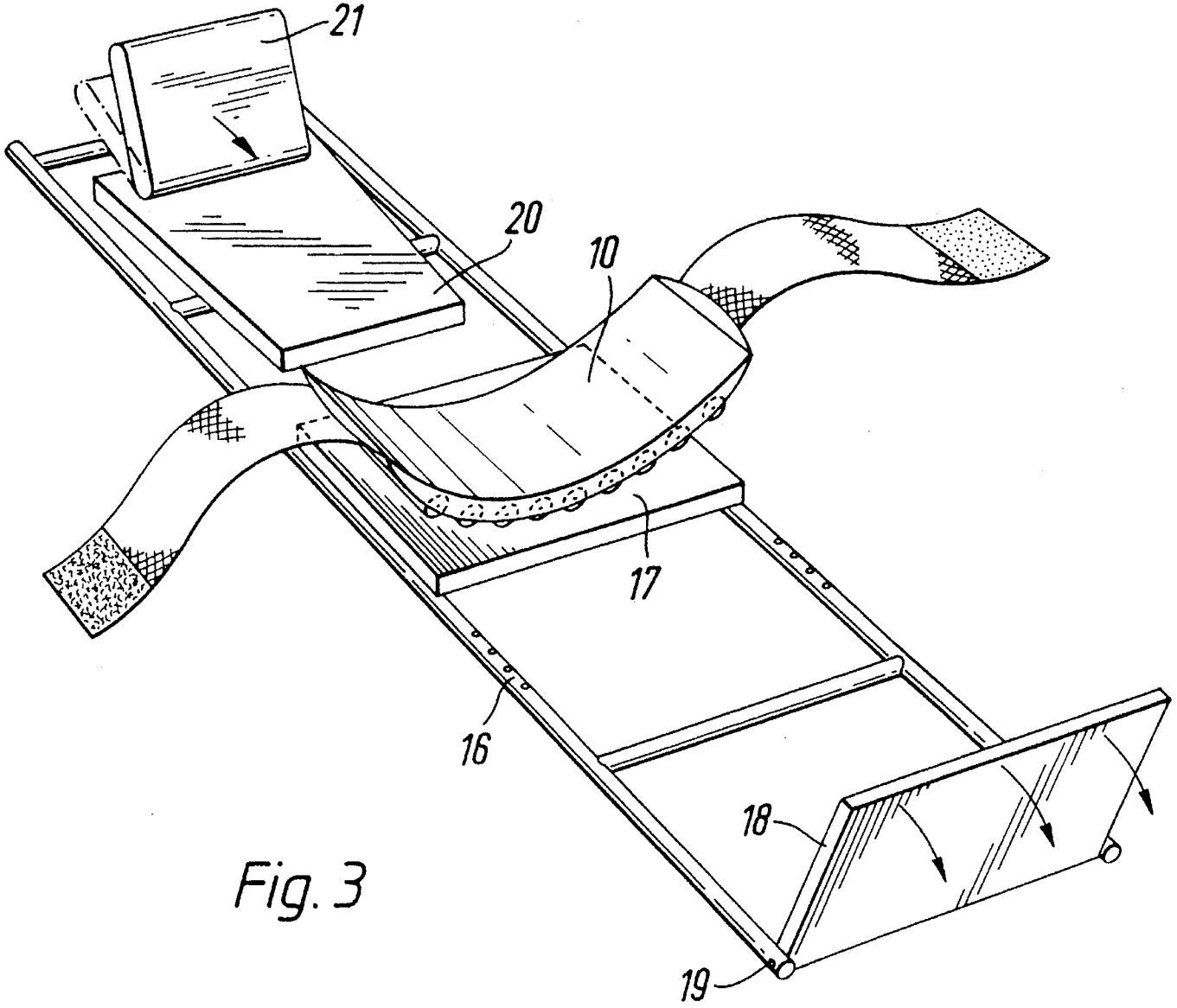
FIG. 3 shows an exercise device embodying the present invention when used in conjunction with a frame embodying a head rest and a foot rest.

In FIG. 3 the same exercise device with its body 10 is shown when used in conjunction with an adjustable frame 16. The frame supports a base board 17 to accommodate the exerciser. The base board may be flat or may be curved across the width of the frame so as to assist the user in remaining on the base board. The base board itself may be adjustable in position and the frame may be adjustable in length to accommodate people of different heights.

As seen, the frame has a foot rest 18 pivoted at 19, the angle of the frame being adjustable to give the required rest position for the user's feet.

At the other end of the frame is a cushion 20 adapted to support the user's shoulders and an adjustable head rest 21.

The exerciser may be used in conjunction with the frame as shown, or it may be used separately. For instance, the frame may be used at home but the exerciser may be taken on holiday and used in a hotel room or any other convenient place. The frame may be made of light aluminium tubing or other material such as plastic tubing and may be made available in kit form so that it can be assembled and used and then put away again so that it does not occupy the exercise space all the time.

The wheels or rollers of the exercise device may be driven by electric motors (not shown) and, as described above, may be powered by batteries or mains power. Micro-switches may be incorporated so that the required reciprocal motion is achieved.

I claim:

1. An exercise device adapted to be fastened laterally around a body of a user at hip, waist or shoulder level comprising:

a elongated body portion adapted to contact the body of the user, said body portion including first and second ends that are spaced in a lateral direction;

means for fastening said body portion to a user at hip, waist or shoulder level, said fastening means extending laterally outwardly from the first and second ends of said body portion;

means to reduce or ease friction between the device and a floor or wall when the exercise device is in use, the friction reducing means being held by the body portion so that, in use, the friction reducing means is spaced from the body of the user, said friction reducing means including a plurality of laterally spaced rollers rotatably attached to said body portion for rotation about respective axes which are substantially perpendicular to said lateral direction.

2. An exercise device according to claim 1, said device being rigid but pre-shaped to suit the user.

3. An exercise device according to claim 1, wherein said fastening means comprises a harness by which said device may be attached to the user.

4. An exercise device according to claim 3, said harness further comprising a releasable attachment strip to secure the device to a user.

5. An exercise device according to claim 1, wherein said body portion of said device is flexible to thereby accommodate the shape of a user's body.

6. An exercise device according to claim 1, further comprising, in combination, an adjustable frame including at least one cushion for supporting a portion of the body of the user.

7. An exercise device comprising:

a body portion having opposing first and second sides and first and second ends that are spaced in a lateral direction;

means for fastening said body portion laterally across a body section of a user at hip, waist or shoulder level with the first side of said body portion contacting the body section, said fastening means extending laterally outwardly from the first and second ends of said body portion; and friction reducing means carried by said body portion along the second side thereof, said friction reducing means being adapted to contact a support surface, at a position spaced from the body section of the user, during use of said exercise device, said friction reducing means including a plurality of laterally spaced rollers rotatably attached to said body portion for rotation about respective axes which are substantially perpendicular to said lateral direction.

8. An exercise device according to claim 7, wherein said body portion is rigid and shaped to conform to the body section of the user.

9. An exercise device according to claim 7, wherein said body portion is flexible.

10. An exercise device according to claim 9, wherein said body portion is formed of plastic.

11. An exercise device according to claim 7, wherein said fastening means comprises a harness.

* * * * *